US006672911B2

(12) United States Patent
Zhao et al.

(10) Patent No.: US 6,672,911 B2
(45) Date of Patent: Jan. 6, 2004

(54) ELECTRICAL TERMINAL SOCKET ASSEMBLY INCLUDING 90 ANGLED AND SEALED CONNECTORS

(75) Inventors: Weiping Zhao, Canton, MI (US); Robert F. Gutman, Fraser, MI (US)

(73) Assignee: Alcoa Fujikura Limited, Franklin, TN (US)

( * ) Notice: Subject to any disclaimer, the term of this patent is extended or adjusted under 35 U.S.C. 154(b) by 0 days.

(21) Appl. No.: 10/079,206

(22) Filed: Feb. 21, 2002

(65) Prior Publication Data

US 2002/0123275 A1 Sep. 5, 2002

Related U.S. Application Data

(63) Continuation-in-part of application No. 09/951,012, filed on Sep. 14, 2001.

(60) Provisional application No. 60/232,698, filed on Sep. 15, 2000, and provisional application No. 60/271,776, filed on Feb. 27, 2001.

(51) Int. Cl.[7] ..... H01R 13/187

(52) U.S. Cl. ..... 439/845; 439/587; 439/271

(58) Field of Search ..... 439/694, 881, 439/902, 843, 845, 271, 274, 275, 587, 589

(56) References Cited

U.S. PATENT DOCUMENTS

| | | | | | |
|---|---|---|---|---|---|
| 3,218,606 | A | | 11/1965 | Schultz | 339/256 |
| 4,128,293 | A | | 12/1978 | Paoli | 339/258 R |
| 4,445,747 | A | | 5/1984 | Neidich | 339/256 R |
| 4,657,335 | A | | 4/1987 | Koch et al. | 339/256 R |
| 4,734,063 | A | | 3/1988 | Koch et al. | 439/844 |
| 4,934,965 | A | * | 6/1990 | Buddrus et al. | 439/845 |
| 5,261,840 | A | | 11/1993 | Benz | 439/843 |
| 5,269,699 | A | * | 12/1993 | Peloza | 439/268 |
| 5,525,070 | A | * | 6/1996 | Axelsson | 439/268 |
| 5,588,884 | A | * | 12/1996 | Rudoy et al. | 439/845 |
| 5,667,413 | A | * | 9/1997 | Trafton | 439/843 |
| 5,681,187 | A | * | 10/1997 | Fukushima et al. | 439/700 |
| 5,725,392 | A | * | 3/1998 | Bianca et al. | 439/590 |
| 5,879,205 | A | * | 3/1999 | Egenolf et al. | 439/852 |
| 5,921,822 | A | | 7/1999 | Kennedy et al. | 439/851 |
| 6,017,253 | A | | 1/2000 | Schramme | 439/851 |
| 6,276,960 | B1 | | 8/2001 | Schaefer et al. | 439/522 |
| 6,287,156 | B1 | * | 9/2001 | Swan et al. | 439/845 |
| 6,416,340 | B2 | * | 7/2002 | Schaefer et al. | 439/224 |

FOREIGN PATENT DOCUMENTS

| | | | |
|---|---|---|---|
| DE | 1665132 | 1/1971 | |
| DE | 19833675 A1 | 2/2000 | H01R/43/16 |

* cited by examiner

*Primary Examiner*—Tho D. Ta
*Assistant Examiner*—Larisa Tsukerman
(74) *Attorney, Agent, or Firm*—Tracey D. Beiriger

(57) ABSTRACT

A terminal socket assembly for electrically connecting a male input blade with an output cable. The socket assembly includes a spring cage exhibiting a three dimensional rectangular and arcuate cross sectional shape having a plurality of angled and torsioned beams. A sleeve exhibits a similar rectangular configuration and receives the configured spring cage in axially inserting and interference fitting fashion and so that the assembled sleeve and spring cage is capable of biasingly receiving and engaging the male blade. Gripping portions are integrally secured to the rectangular sleeve and fixedly engage an extending end of a cable to electrically communicate the cable to the blade. A sealed connector housing encases the terminal socket assembly and extending connector cables and encloses the assembled spring cage and sleeve. Other elements of the housing including a seating terminal position assurance element, seals and retainer elements engageable with opposite open ends of the housing.

38 Claims, 7 Drawing Sheets

FIG - 3
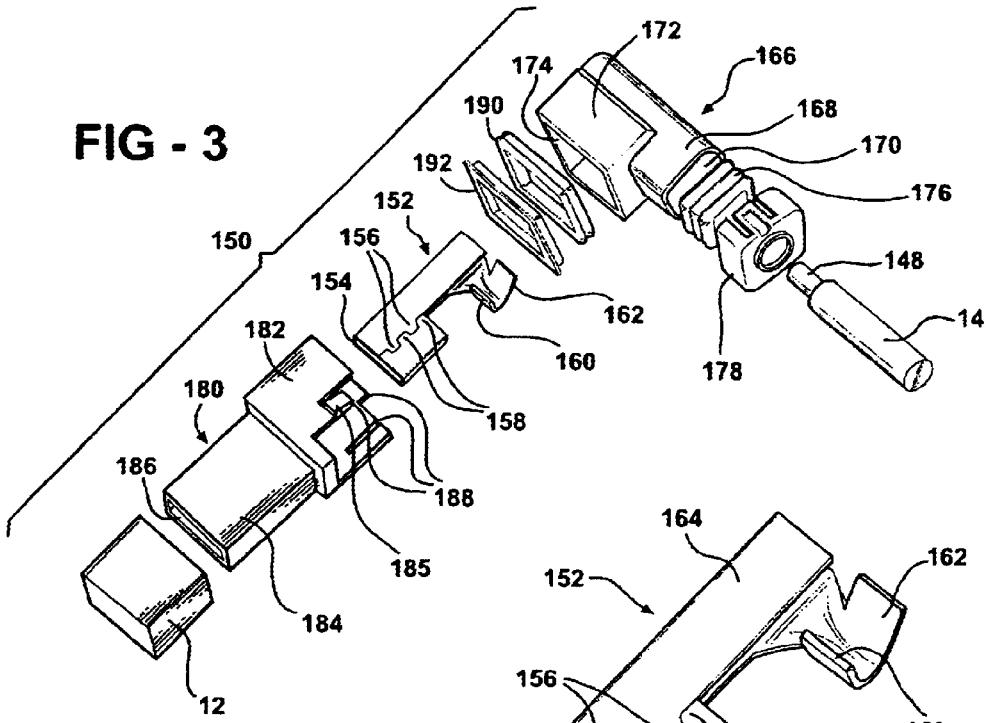
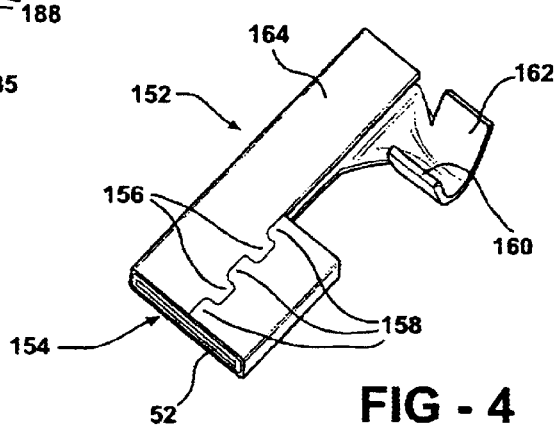
FIG - 4
FIG - 5
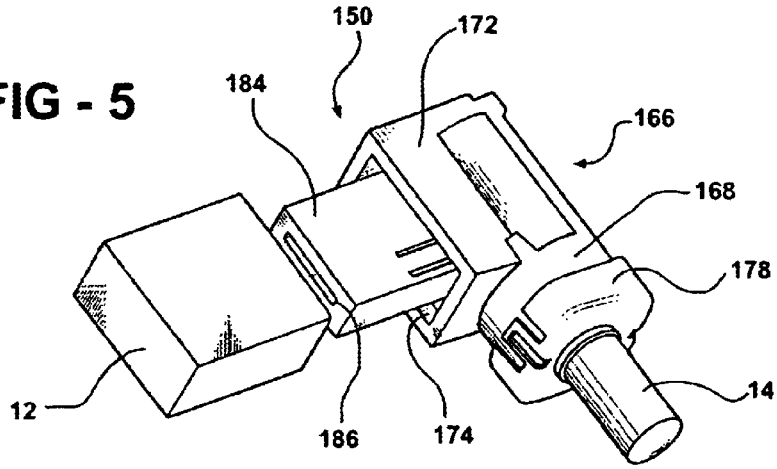

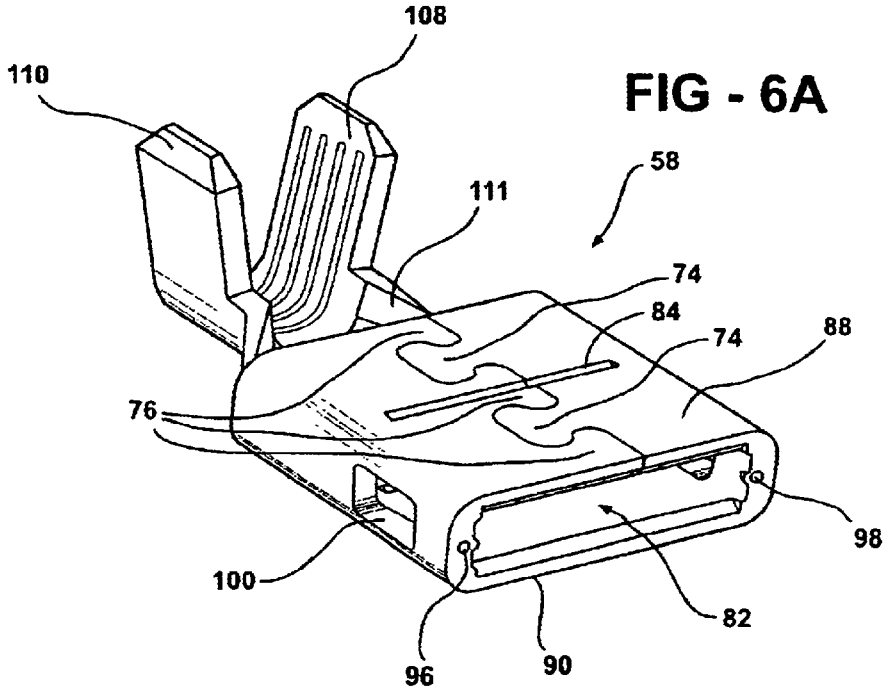
FIG - 6A
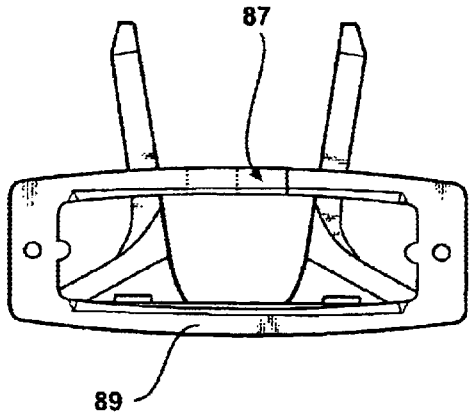
FIG - 6C
FIG - 7
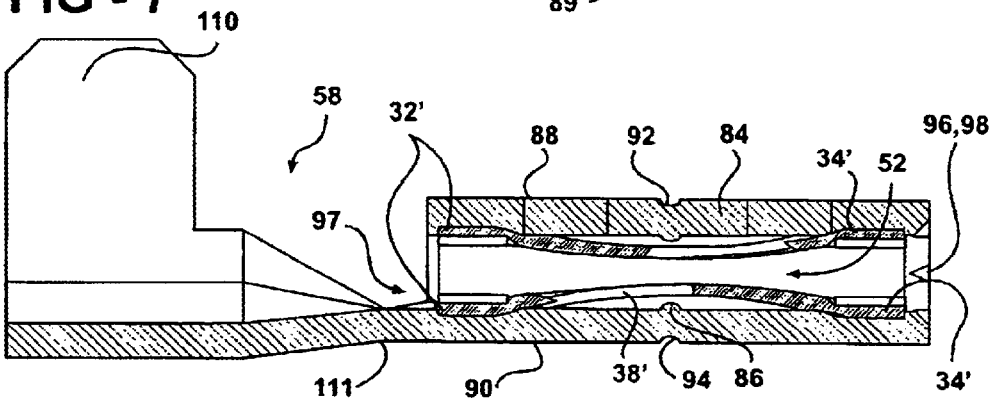

FIG - 13
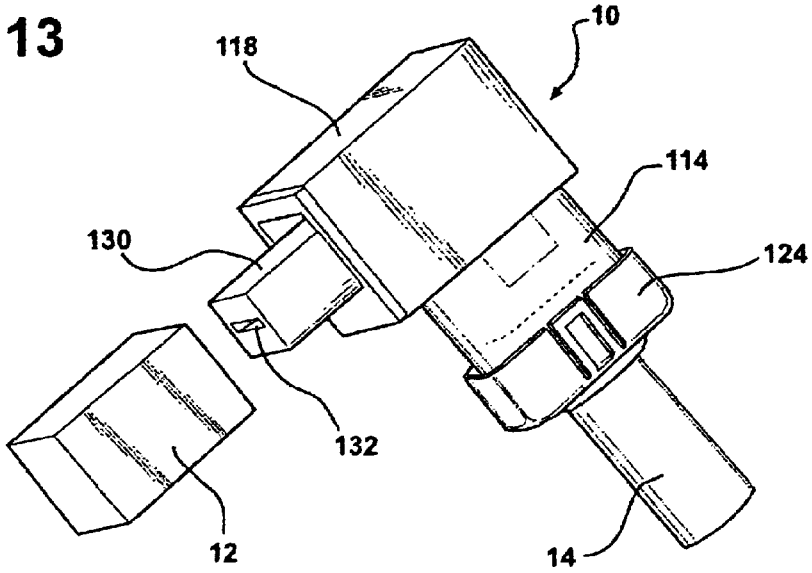
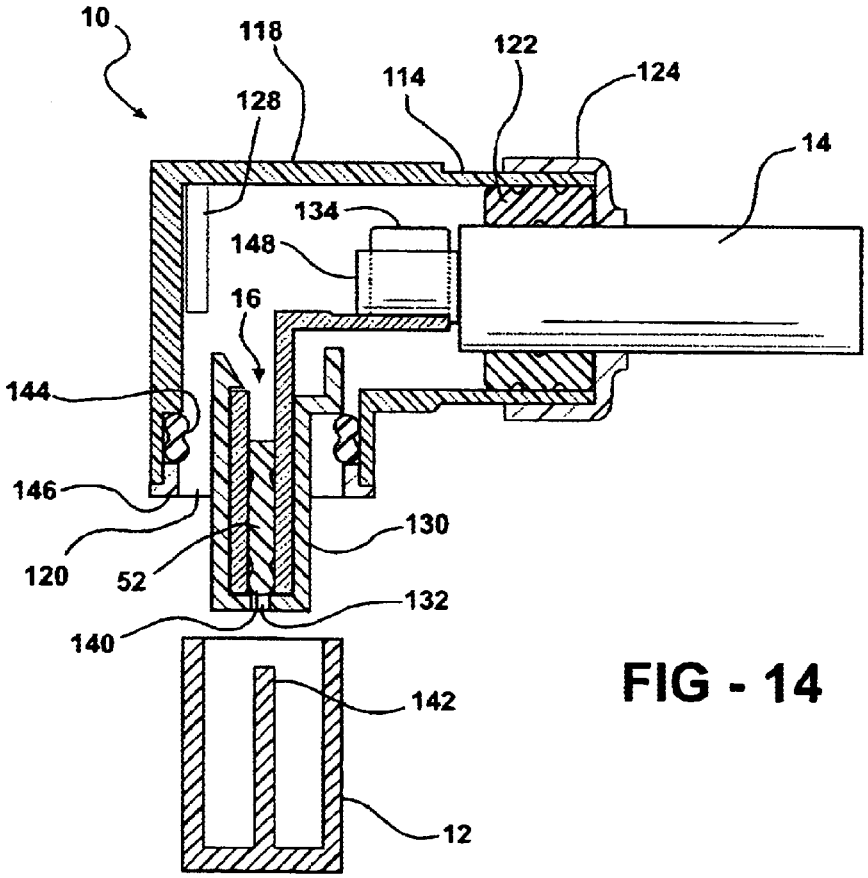
FIG - 14

ELECTRICAL TERMINAL SOCKET ASSEMBLY INCLUDING 90 ANGLED AND SEALED CONNECTORS

REFERENCE TO COPENDING APPLICATIONS

The present application is a continuation-in-part application of U.S. Application Ser. No. 09/951,012 filed Sep. 14, 2001, and entitled "Electrical Terminal Socket Assembly Including Both T-Shaped and 90° Angled and Sealed Connectors", which claims benefit of U.S. Provisional Application Serial No. 60/232,698, filed Sep. 15, 2000, and U.S. Provisional Application Serial No. 60/271,776, filed Feb. 27, 2001, both entitled "Power Feed Attachment".

FIELD OF THE INVENTION

The present invention relates generally to sealed power connectors for 90° terminal assemblies and power feed attachments, such including resilient engagement capability. More particularly, the present invention is directed to an electrical terminal socket assembly and method for constructing which incorporates a substantially rectangular and compressible contact spring cage and an encircling compressible terminal sleeve for holding the spring cage in place. The contact spring cage and sealed connector assembly provides a low cost solution for a quick connect assembly and which provides both increased contact surface area between the spring cage and associated male terminal, as well as a much greater degree of torque control in assembly as opposed to prior art bolt and nut type cable connections. The present invention further discloses a 90° sealed connection housing, which includes angled variations of the terminal socket assembly enclosed within interengaging male and female outer connecting portions, and for better insulating and sealing the electrical connections established by the socket assembly. The configuration of the rectangular spring cage has further been found to provide sufficient contact surfaces necessary for maintaining the voltage and current carrying applications associated with larger capacity battery/power sources.

BACKGROUND OF THE INVENTION

Electrical connectors of the terminal socket variety are well known in the art, one primary application of which being in the automotive field for establishing connections between heavier sized output cable and components such as generators or alternators. The frictional grip imparted by the connector must be of sufficient strength to maintain firm mechanical and adequate electrical connection, yet must permit relatively easy manual withdrawal or insertion of a prong into the connector socket.

One type of known prior art electrical cable connection is the bolt-nut type electrical cable connection. A significant problem associated with such bolt and nut arrangements arises from the amount of torque which is necessary to assemble the connector and the difficult quality control issues which arise from its large scale use such as over torque, under torque and cross thread.

Most power connection systems in the relevant art include circular type terminals. For certain applications, these require a number of components and processes in their assembly. For example, in power electrical distribution systems such as in vehicle fuse boxes, part of a copper sheet is stamped and formed into a round hollow pin. Occasionally, an additional solid pin is staked onto the copper sheet. However, and if a blade terminal is utilized, the male blade is stamped (not formed like a pin) as part of the copper sheet. This assembly does not require more process stages or par like a round pin.

It has been found that power blade terminals provide a better solution for space limitation in one direction, in some applications than in utilizing round power pin terminals. Conventional power blade terminals typically include a loose spring cage within a sleeve and in which a contact length established between the spring beam and male blade is small, thus resulting in the current carry capability being relatively low. Mechanically, a good terminal system ensures a low engaging force, while establishing a high normal (perpendicular) force. This results in the higher ratio of terminal insertion force over normal force between the male and female terminals providing an overall better terminal system. The ratio of insertion force over normal force has also been found to be very low for most conventional blade terminals.

It has also been found that aftermarket sealed female connectors (plastic housings) are typically only provided for straight terminal assemblies. In order to accommodate 90° connections, male pin or blade terminals usually are bent to right angles then mated with a straight female terminal assembly sealed inside a female connector. However, some applications do not allow or are not cost effective to bend the male terminal to 90° angular relationship. Thus, there has not been found to be any acceptable remedy to this kind of situation, especially for any power connection systems.

In sun, the present invention lacks a power blade terminal system which provides cost effective design and optimal package space in certain applications. It has also been determined that it is important to maintain sufficient contact surface and high normal force (between the male pin and socket cage) in order to guarantee that an adequate amount of electrical current is carried through the terminal assembly, while at the same time reducing the insertion force as low as possible. A sealed 90° female connection has also been determined to be required for certain power applications.

SUMMARY OF THE INVENTION

The present invention discloses an electrical terminal socket assembly and method for constructing which incorporates, as a subassembly of the overall socket assembly, a substantially rectangular and compressible spring cage and a supporting rectangular shaped and compressible terminal/contact sleeve for holding the spring cage in place. As previously explained, the present assembly and method for constructing provides a low cost solution for a quick connect assembly and which requires a much greater degree of torque control in assembly, as opposed to prior art bolt and nut type cable connections. The present invention is also an improvement over prior art assembly techniques which require the spring cage element to be formed in place after it is has been inserted into the corresponding sleeve component, particularly in that the present invention provides only two components and a simplified assembly process. It is further contemplated that the assembly part can be manufactured in conjunction with a fast speed progression die.

A spring cage blank has first and second extending edges and a plurality of spaced apart and angled beams extending between the edges. As disclosed in copending application Ser. No. 09/951,012, filed Sep. 14, 2001, and in a preferred variant, it is contemplated that a plurality of the spring cage blanks may be provided in spaced fashion between first and second carrier strips and which permit the blanks to be transferred in succession into an appropriate die stamping, tool punching or other suitable forming operation. As is again previously described in U.S. Ser. No. 09/951,012, it is further contemplated that such stamping or other forming operation may further include the provision of first and second spaced apart and opposing mandrels, each exhibiting a suitable exterior configuration for shouldering and forming the three dimensional rectangular configuration of the compressible spring cage.

Aspects of the rectangularly formed spring cage include the combined bending of the individual beams along their axially extending directions, combined with torsioning (or twisting) each of the beams in a direction perpendicular to their axial extending length. The suitable tool punching or die forming operations performed on the spring cage, during its transition from a blank form to a substantially rectangular and three dimensional shape, further imparts an outwardly flared and arcuate configuration to each of the spaced apart faces of the spring cage.

The contact sleeve is likewise provided in initial blank form and, upon completion of the suitable forming operations, exhibits a likewise substantially rectangular shaped three dimensional body with open interior communicated by first and second open ends. The longer sides of the rectangular shaped cage are slightly imparted to be outwardly flared and adopt an arcuate configuration relative to the sleeve. Contact tab portions extend from the rectangular encasing portion of the sleeve and, as will be subsequently described, are crimped/bent to engage extending and exposed wire end portions of an associated electrical cable.

The contact sleeve is otherwise shaped with an open interior dimension permitting easy insertion of the spring cage, upon which crimping or compressing operations are conducted for retaining the spring cage in fixed and pressure retaining fashion. Along these lines, the sleeve is typically slitted or otherwise configured so that opposing edges are separated by a specified gap and are capable of being compressingly engaged together. In a preferred variant, meshing keyed portions are defined along the slitted and gapped surface and so that, upon inserting assembly of the formed spring cage, the exterior surface of the sleeve is compressingly engaged (such as again through the employed of stamping dies or other suitable manufacturing operation) and in order to create a desired interference fit between the spring cage and the interior of the sleeve.

Additionally, linearly extending portions of the spaced apart faces of the sleeve may be collapsed inwardly to further grip and secure the interiorly held spring cage. An arcuate configuration impartial to each of the spaced apart faces of the spring cage exhibits a smaller radius than the arcuate configuration of the sleeve. The spaced apart faces of the spring cage are thus strongly compressed and therefore create a strong pressure between the spring cage and sleeve, however the spring cage is found to not collapse by virtue of the arcuate configurations of the spring cage and sleeve, and with assistance from assembly tools which hold the inside dimensions at both ends. The principle for this is similar to that of an arcuate bridge, which can withstand heavy weight from the top.

The interference fit created between the spring cage and sleeve provides the primary retaining feature of the terminal socket assembly. Additional lances may however be protruded at a transition location along a back edge of the sleeve box. The lances function as a forward stop when assembling the spring cage into the sleeve and further assist in retaining the cage inside the sleeve. Along a front insertion face of the sleeve, crimping portions may also be accommodated at lateral edge locations. The crimping portions also function as an assist in retaining the cage inside the sleeve, it again being understood that the lance and crimping feature are, at most, supplemental in retaining the cage inside the tubular sleeve and that the primary holding forces arise from the collapsing/compressing force of the sleeve about the interiorly encased spring cage.

In order to complete the electrical connection, an extending end of a male blade is secured within the interiorly hollowed sleeve and assembled spring cage. Again, angled beams are extended between the edges of the associated spring cage. The rectangularly formed spring cage includes the combined bending of the individual beams along their axially extending directions, combined with torsioning (or twisting) each of the beams in a direction perpendicular to their axial extending length. The contact length between the male blade and spring beams is toward a diagonal direction, instead of a width of a beam of conventional beam design. Therefore, the configuration of the spring cage in particular maximizes both the surface area of contact between the configured beams and the associated male blade.

With angled, curved and torsioned (or twisted) bending of each of the beams, the male blade is inserted into the spring cage, within the sleeve and deflects and twists the spring beams, instead of deflecting the spring beam only such as in conventional spring beams. In contrast, conventional beams of associated spring cages usually are not angled and/or twisted. In this fashion, it has been found to use much less force to deflect and twist the spring beams, as compared to higher forces needed to deflect spring beams in conventional spring beam designs. Also, the present design reduces the necessary insertion force of the blade pin into the spring cage/sleeve assembly; concurrent with establishing a relatively higher normal force established between the pin and cage.

During insertion of the male blade at its engaged position with spring cage-sleeve assembly, the male blade may potentially overstress the spring beams, particularly if the male blade is wiggled or bent by outside factors. Accordingly, two ribs on the top and bottom of the sleeve are protruded inwardly, such that the spring beam will be stopped by the two ribs in the event the beams are deflected a pre-specified distance. The sleeve, in any of a number of alternate variants, further includes actuable gripping portions for fixedly engaging against and securing an extending end of a cable. The gripping portions may further be configured so that the cable extends in an angular (typically 90°) relationship relative to the male blade secured to the sleeve and spring cage assembly.

Assembly configurations of the quick connect socket assembly further disclose 90° sealed housing constructions, such as including a female housing connector, terminal position assurance, and associated seals and retainers for electrically and environmentally sealing and insulating the socket assembly and extending cables. A method to assemble a 90° female terminal assembly is also disclosed in the present invention. After the interfacial seal is assembled to connector housing, the interfacial seal retainer is ultrasonically welded to the connector housing at the connector manufacturer. The connector housing sub-assembly, terminal position assurance, grommet, and grommet retainer are then shipped to the wire and harness manufacturer for further assembling. In a first assembly step, a grommet retainer and grommet are slidably engaged onto a cable. Second, the cable is bent and pushed through a female housing connector. In a third step, grip portions of the female terminal assembly are crimped and the female terminal-cable assembly is retracted such that female terminal seats at the proper position inside the female housing connector. A terminal position assurance is assembled, and, finally, the grommet and grommet retainer are assembled upon the female housing connector to complete the assembly.

A method for assembling the spring cage of the terminal socket assembly is also disclosed, substantially according to the afore-described assembly, and includes the steps of providing at least one spring cage blank with first and second extending edges and a plurality of spaced apart and angled beams extending between the extending edges and forming the spring cage blank into the substantially rectangular shaped configuration and in which the angled beams are arranged in the combined angled/curved/torsioned manner, the extended edges of the beams being formed in an arcuate configuration. Additional steps include forming/providing the substantially rectangular shaped and interiorly hollowed sleeve with a slightly arcuate configuration on both the top and bottom of the sleeve, insertably assembling the formed spring cage into an open end of the sleeve, and compressingly actuating the sleeve in biasing fashion about the spring cage so that it can biasingly engage an extending end of the male blade in which the spring beams are over stress protected by the two ribs of the sleeve; concurrently, the sleeve grips an extending end of the cable at a further location in order to electrically communicate the male blade with the cable.

BRIEF DESCRIPTION OF THE DRAWINGS

FIG. 3 is an exploded view of a 90° sealed connector assembly and which incorporates a formed terminal sleeve, again in use with a compressible spring cage and according to a second preferred embodiment of the present invention;

FIG. 4 is an isometric view of the formed 90° sleeve as illustrated in FIG. 3;

FIG. 5 is an assembled view of the sealed connector assembly as illustrated in FIG. 3 and which further shows the manner in which the male connector attaches to an exposed end of a terminal position assurance element incorporated into the assembly;

FIG. 6*a* is a subassembly view of a sleeve assembly according to a preferred variant for encasing a rectangular shaped spring cage and which further illustrates the features of the interlocking keystone arrangement, forward facing crimping portions, cross wise extending indentations in the spaced apart sleeve faces, and laterally configured locking windows;

FIG. 6*c* is an illustration of a front view of the sleeve again with interlocking keystones in a pre-engaging position and top and bottom exhibiting a slightly arcuate shape, and prior to subsequent insertion of the spring cage and compressing operations performed to achieve its eventual shape as shown in FIG. 6*a;*

FIG. 7 is a side cutaway of the sleeve of FIG. 6*a* and illustrating the substantially rectangular shaped and compressible spring cage in inserted and biasingly engaged fashion within the interior of the sleeve, one of two lances also being shown protruded at a transition location along a back edge of the generally sleeve box shape;

FIG. 13 is an assembled view of the sealed connector assembly as illustrated in the embodiment of FIG. 1 and which likewise shows the manner in which the male connector attaches to an exposed end of a terminal position assurance element incorporated into the assembly; and FIG. 14 is a cutaway of the assembled view of FIG. 13 and which illustrates the manner in which the spring cage/sleeve sub-assembly is incorporated into the sealed and 90° bent connector housing assembly.

DETAILED DESCRIPTION OF PREFERRED EMBODIMENTS

Figure 1:
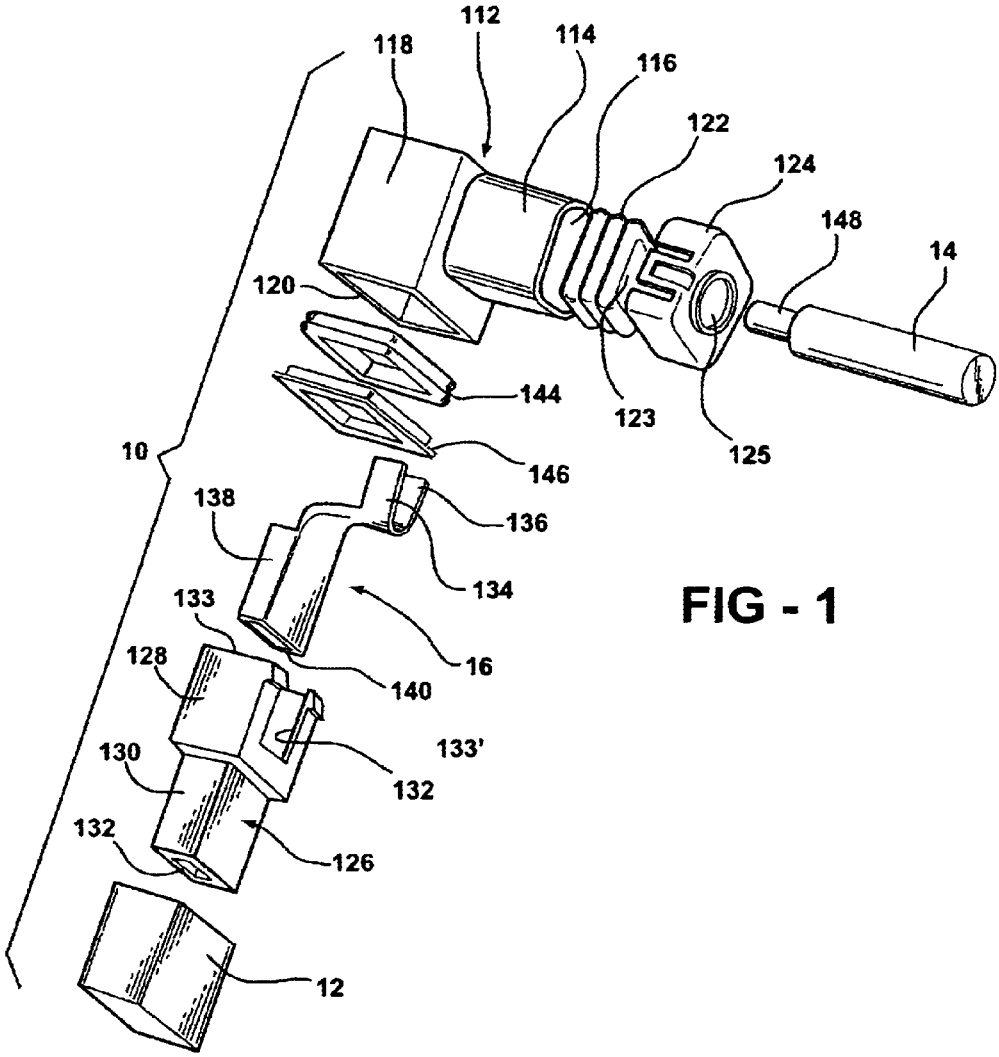
FIG. 1 is an exploded view of a 90° sealed connector assembly which incorporates a bent terminal sleeve in use with a compressible spring cage and according to a first preferred embodiment of the present invention.

Referring to the appended drawing illustrations, and in particular to FIGS. 1, 13 and 14, an electric terminal socket assembly 10 is illustrated according to one preferred embodiment of the present invention and in order to interconnect electrically powered vehicular components (not shown) via an associated male connector (such as a male input blade) 12 and a cable (such as providing an output) 14, such connecting inputs and outputs as blades and cables typically corresponding to an input or output of selected vehicular components. As previously described, the terminal assembly and method for constructing provides a low cost solution for a quick connect assembly and which requires a much greater degree of torque control in assembly, as opposed to prior art bolt and nut type cable connections and some round pin solutions; the present invention also providing a solution for certain application with package constraints.

The present invention is also an improvement over prior art assembly techniques which require the spring cage element to be formed in place after it is has been inserted into the corresponding sleeve component. The various exploded, assembled and cutaway views illustrate the overall aspects of the sealed connector assembly of FIGS. 1, 13 and 14. A plastic housing provides the sealing characteristics for the 90° terminal assembly according to the invention, with unique processing of assembling the terminal assembly into a female housing connector and as will be subsequently described. Prior to additional description of these features, an explanation will also be made as to the spring cage and terminal sleeve sub-assembly, illustrated generally at 16, and forming a part of the overall connector assembly 10.

Figure 9:
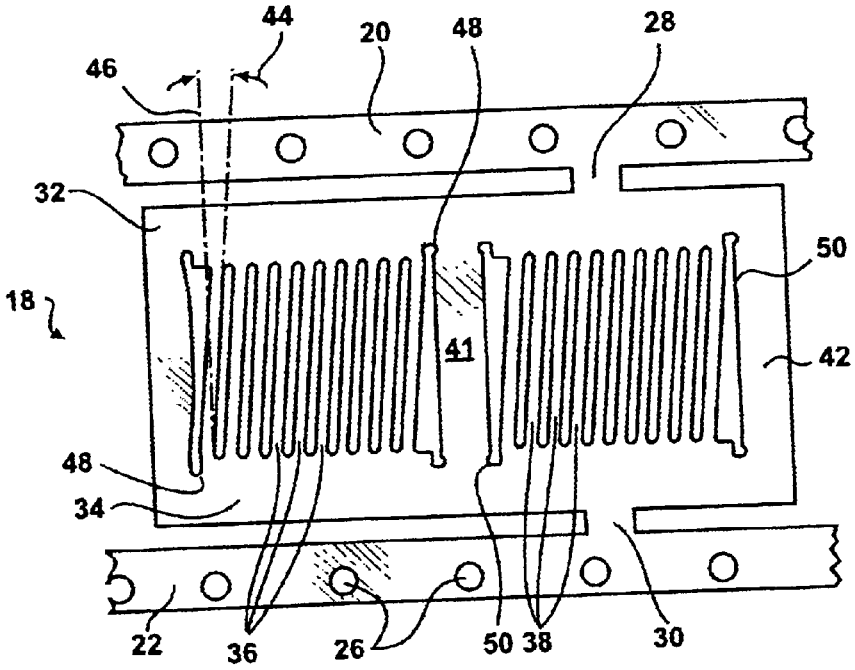
FIG. 9 is an illustration of the rectangular spring cage, in initial blank form, and which exhibits a plurality of angled and spaced apart beams supported between upper and lower carrying strips according to the present invention.

Referring to FIG. 9, a spring cage blank assembly is generally illustrated at 18 and, in a preferred embodiment, may include individual and spaced apart spring blanks (not shown) as again described in copending application U.S. Ser. No. 09/951,012. The blank 18 (or plurality of spaced apart blanks) are supported upon a pair of first 20 and second 22 carrier strips. The carrier strips 20 and 22 each in turn include spaced apart and axially defined apertures, such as at 24 for carrier strip 20 and at 26 for carrier strip 22. The strips in turn establish connecting portions with the blank 18 (referenced by connecting portion 28 for strip 20 and connecting portion 30 for strip 22).

The apertures 24 and 26 defined in the upper 20 and lower 22 carrier strips permit the blank assembly 18 to be transported upon a suitable conveying apparatus (not shown), such as which operates in conjunction with a suitable stamping, forming or, preferably, a die punching operation. The connecting portions 28 and 30 further function to provide first and second supporting locations for the subsequent shaping and forming operations to be performed on the spring cage blank 18.

The spring cage blank 18 is constructed of a spring copper material, having a specified thickness and configuration. In particular, a first (or upper) extending border 32 terminating in a top edge is secured to the first carrier strip 20 via upper connecting portion 28. A second opposite and spaced apart (lower) extending border 34 terminating in a bottom edge is secured to the second carrier strip 22 via lower connecting portion 30.

First and second individual pluralities of spaced apart and angled beams are located at 36 and 38 in individually spaced and arrayed fashion within the main body of the blank 18, in somewhat inwardly spaced fashion from the extending edges 32 and 34 and opposite side extending edges 40 and 42, as well as separated by a middle spacing portion 41 of the blank 18. In one variant, the individual pluralities 36 and 38 of beams are provided at a slight angle 44, such as ranging typically, but not limited to, from between 5° to 10° relative to a longitudinal direction (see at 46 in FIG. 9) and in order to provide the plan view appearance of the spring clip 18 with an overall rectangular shape and particularly parallelogram shape for the series of spring beams.

Figure 10:
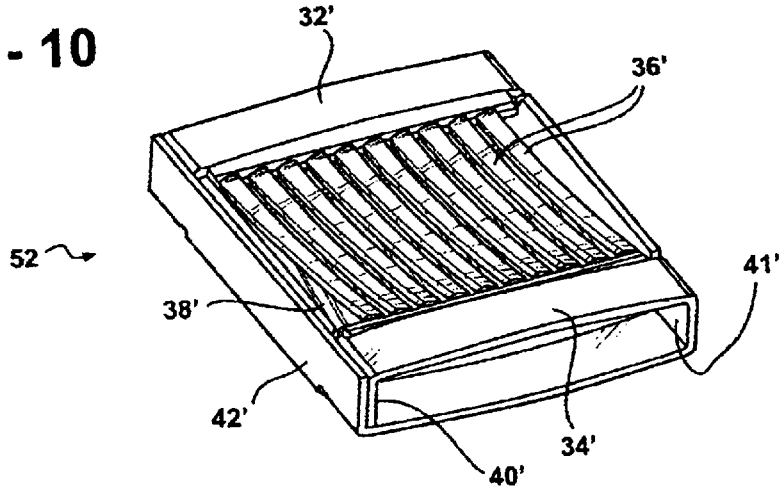
FIG. 10 is an isometric perspective of the formed rectangular spring cage according to the present invention and particularly illustrating both the arcuate cross wise extending configuration of the spaced apart cage faces, as well as the combined angling/torsioning of the individual beams.
Figure 11:
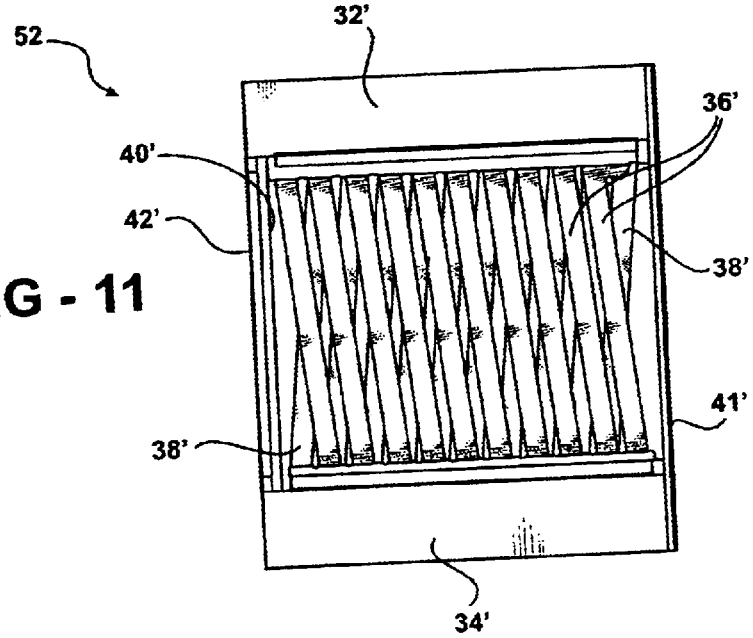
FIG. 11 is a top view of the rectangular spring cage illustrated in FIG. 10 and again illustrating the arrangement of the individual and angled/torsioned beams.
Figure 12:
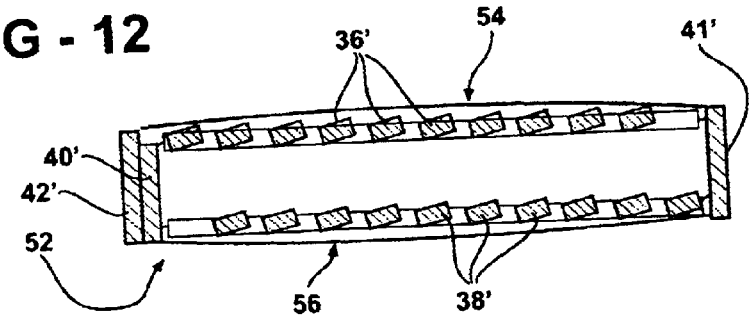
FIG. 12 is a further end view of the spring cage also shown in FIGS. 10 and 11.

Additional and uniquely configured pairs of end portions (at 48 for beams 36 and at 50 for beams 38) are provided in inwardly spaced manner between the side extending edges 40 and 42 of the blank and, as will be better described in references to FIGS. 10–12 and upon three dimensional assembly of the blank into the desired spring cage shape, ensure the creation of relatively smooth side edge surfaces of the rectangular and three dimensional spring cage combined with proper transition to the beams 36 and 38 arrayed on opposite facing surfaces of the assembled cage. It is however understood that the spaced apart individual pluralities 36 and 38 of the beams (as illustrated in blank form in FIG. 9) may be provided at any suitable angle, such as no angle, relative to the upper and lower extending edges of the blank, the result of which typically having some affect on contact force between male pin and terminal socket assembly.

As described previously, a suitable forming, or die punching operation is employed to configure the spring blank 18 of FIG. 9 into a three dimensional and rectangularly formed spring cage as again illustrated in each of FIGS. 10, 11 and 12 and referenced at 52. Copending application U.S. Ser. No. 09/951,012, filed Sep. 14, 2001 and from which the present application claims priority in part, describes a plurality of individual die forming operations, such as which may include the provision of opposing and inwardly facing mandrels, female configured die forming surfaces, and an assortment of bending or twisting operations for configuring the spring cage blank into its desired three dimensional shape (in that instance being a cylindrical and substantially "hourglass" configuration). It is understood that similar forming operations may be incorporated into the present application for forming the spring cage into its desired three dimensional and rectangular configuration 52, as well any other suitable die forming or punch tool operation (executed in any number of desired manufacturing steps) for achieving the desired three dimensional and internally open configuration of the configured spring cage 52.

Referring again to FIGS. 10–12, the three dimensionally configured spring cage 52 is illustrated in successive perspective, top plan and cross sectional vantages and which illustrates a slightly arcuately (outwardly) flared configuration of the formed opposite faces of the rectangular cage (see as generally referenced at 54 and 56 in the end cross section of FIG. 12). Additional features include bending and twisting operations performed on the individual pluralities of beams 36 and 38 (as previously described) and in order impart a combined angling and torsioning (twisting) of the beams in order to maximize available surface area contact with the associated male connector with terminal blade, concurrent with likewise maximizing the normal forces exerted between the blade and spring cage beams, while at the same time reducing considerably the insertion forces necessary to install the terminal blade. Again, with angled, curved and torsioned (or twisted) forming of each of the beams 36' and 38', the associated male blade (inside connector 12) inserted into the spring cage, itself within the sleeve, uses much less force to deflect and twist the spring beams than has been found to be the case with the higher forces needed to deflect a spring beam such as in a conventional bending.

Referring again to FIGS. 10–12, each of the three dimensionally configured and individual plurality of beams (again at 36' and 38') are downwardly/inwardly angled between the opposite connecting portions (32' and 34') and as best shown in the perspective of FIG. 10. At the same time, the torsioning or twisting of each plurality 36' and 38' of beams perpendicular to their extending direction contributes, along with their inwardly angling, to maximizing the available surface area established along a diagonal direction from a length of each beam (much greater than simply a central point location of each individual beam and such as in conventional spring beam designs) for contacting an associated location extending along the opposite facing surfaces of the associated and inserting male blade. In this fashion, the construction of the rectangular spring cage provides significantly increased surface contact area for handling much higher electrical current applications than has been found to be the case with conventional power terminals.

As further illustrated in particular in FIG. 11, the first plurality of beams 36' extend in a first generally angled direction and the second plurality of beams 38' (arrayed on a second and opposite face of the assembly spring cage) extend in an opposite second angled direction. As further best shown in FIG. 12, the bending and twisting operation employed with the spring cage blank 18 results in the intermediate spacing portion (now referenced as 41') defining one cross sectional edge location of the cage 52, whereas the opposite side edge locations are overlapped as now illustrated at 40' and 42' at an opposite edge location.

Referring now to FIG. 6*a*, a substantially rectangularly shaped and interiorly hollowed sleeve is referenced generally at 58 in use with the present invention and which forms a component of the assembleable and terminal socket assembly, in particular the assembled sleeve and spring cage sub-assembly. As also shown with reference to FIG. 6*c*, the sleeve exhibits a slightly arcuately (outwardly) flared configuration at 87 and 89. The sleeve may, similarly to the assembled spring cage 52, be formed of a tensioned copper material and, referring further to FIG. 8, it is contemplated that the sleeve may also be initially provided as a blank shape configuration 60, supported between carrier strips 62 and 64 transferable by individual pairs of spaced apart apertures, 66 and 68 respectively, formed there along their axial lengths, and connected to the strips 62 and 64 by webbed/connecting portions, such as at 70 and 72, respectively. As previously described with reference to the illustration of FIG. 9 of the spring cage blank 18, a plurality of individual and spaced apart tubular sleeves 60 may be provided along the carrier strips 62 and 64 and which are subject to an appropriate stamping/die forming operation for assembling into the desired shape again referenced at 58 in FIG. 6*a*.

Figure 6B:
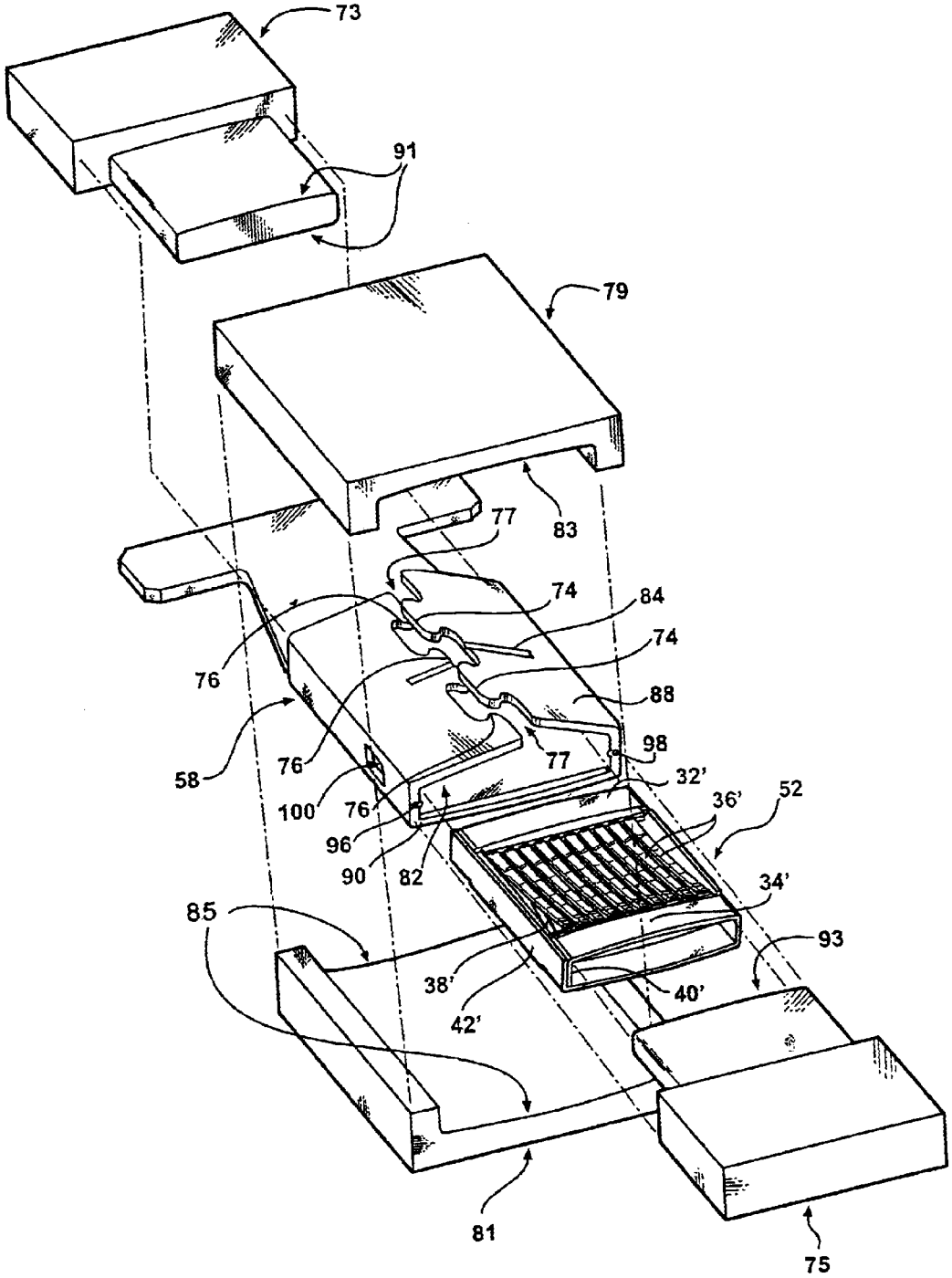
FIG. 6*b* is an illustration of the sleeve with interlocking keystones in a pre-engaging position and prior to subsequent inserting of the spring cage and compressing operations performed to achieve its eventual shape as again shown in FIG. 6*a*, as well as also illustrating the mandrel and compression dies employed in the assembly of the terminal socket.
Figure 8:
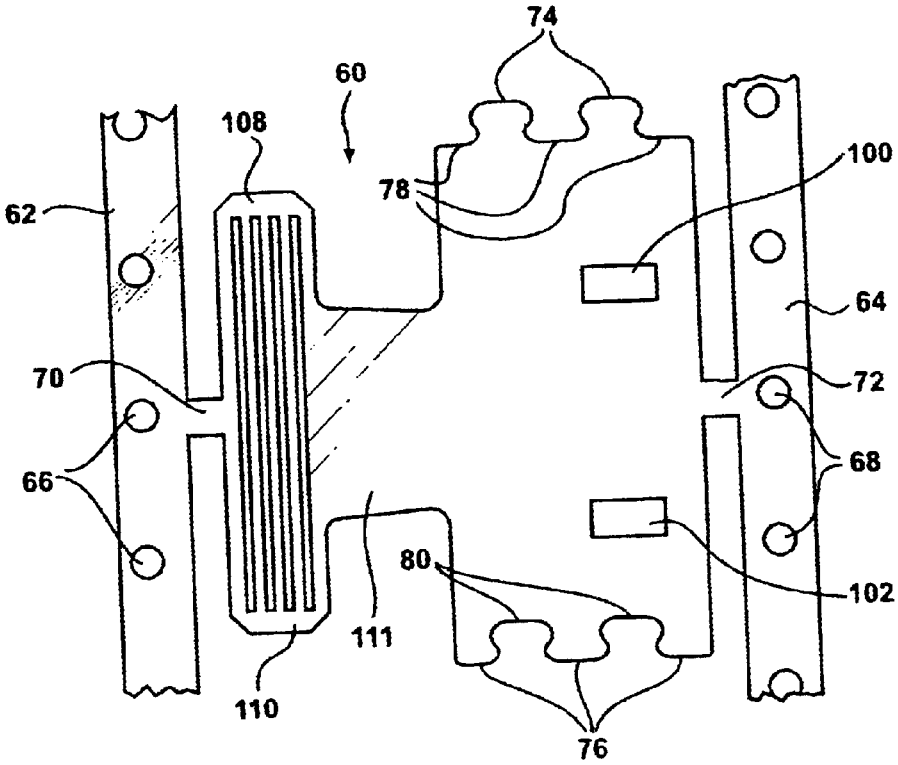
FIG. 8 is an illustration of the sleeve, in blank form, and prior to subsequent forming operations performed to shape as shown in FIG. 6*a;*

Referring again to the blank illustration 60 of FIG. 8, as well as the assembly illustration 58 of FIG. 6*a*, the sleeve according to the preferred variant includes gripping portions in the form of spaced apart and opposing tabs 74 and 76. Upon assembly, the tabs 74 and 76 interlock together by virtue of alternating recesses (see at 78 and 80) defined between the spaced apart tabs 74 and 76 and such as may further permit a slight gap in spacing established between opposing surfaces of the interlocking tabs 74 and 76. As best illustrated in FIG. 6*a*, an incremental spacing 77 in FIG. 6*b* is created by not fully closing the key stone edges (see again tabs 74 and 76). The edges are maintained at a calculated and slightly spaced apart position and for the purpose of introducing the gap in the key stone arrangement created by the alternating tabs 74 and 76 is so that the rectangularly formed spring cage 52 can be inserted freely by moving it within the mandrel 75, and then the tabs (key stones) 74 and 76 being compressed together such as by closing top and bottom dies, 79 and 81, to create the required compressing forces between the spring cage and the sleeve.

As previously explained, an aspect of the sleeve and spring cage subassembly is the ability to pressure and frictionally engage the formed spring cage 52 within the sleeve 58, and as is illustrated in the side cutaway of FIG. 7. The assembled sleeve 58 (as again shown in FIG. 6*b*) includes a forward inserting end 82 dimensioned for receiving the corresponding outline of the spring cage 52 (as shown in the cross sectional end view of FIG. 12) in substantially freely inserting and frictionless fashion and by moving the mandrel 75 in the sleeve direction. This is further due in fact to the incremental spacing 77 illustrated in FIG. 6*b*, again created by not fully closing the key stone edges 74 and 76 and, so that the dimensioning of the inner rectangular opening of the inserting end 82 is slightly larger than that of the outer corresponding edge dimensions of the cross sectionally arrayed rectangular spring cage.

Upon inserting assembly of the cage 52 into the open end 82 of the sleeve 58, a pair of opposite mandrels 73 and 75, see at both 73 and 75, may be arranged in opposite arraying fashion to facilitate insertion of the cage 52 into the rectangular sleeve. At this point, the opposing tabs 74 and 76 (key stone portions) are fully closed through a compressing force, such as by closing dies 79 and 81 illustrated in FIG. 6*b*, applied to the exterior of the sleeve 58 and to maintain the cage 52 in its interiorly arrayed fashion. In this fashion, the inner distance between arcuate sides 87 and 89 of the sleeve in FIG. 6*c* is decreased (by virtue of closing the spacing 77 in FIG. 6*b* between the interlocking key stone tabs), and thereby frictionally and permanently engaging the spring cage within the sleeve.

A further description is also given as to what occurs at a front portion 88 of sleeve 58, and front portion 34' of spring cage 52 as shown in FIGS. 6*b*, 6*c*,and 12. An identical procedure applies to rear portions 76 of sleeve and 32' of spring cage. As mentioned before, the front faces of the spring cage in FIG. 12 and sleeve in FIG. 6*c* are established in arcuate (outwardly flared) configuration. As shown by arcuate surfaces 87 and 89 in FIG. 6*c* and at 54 and 56 in FIG. 12, the arcuate distance of the spring cage is established slightly bigger than the arcuate distance of the sleeve, while the arcuate radius of the spring cage is at the same time slightly smaller than the arcuate radius of the sleeve. The spring cage and sleeve are also illustrated to be slightly overlapping, see at 34' in FIG. 7.

The purposes for the above configurations include first to create a more and broader contact area between the spring cage and sleeve after closing the dies 79 and 81. A second purpose is to create a pressure fit between the spring cage and sleeve, upon the spring cage 52 being crushed by sleeve 58 and the overlap 34' in FIG. 7 is forced to disappear. The arcuate surfaces 87 and 89 of the sleeve 58 (thicker material) will thus force the arcuate surfaces 54 and 56 of the spring cage 52 (typically a thinner material than that employed in the sleeve) to fit or follow the arcuate shape of the surfaces 87 and 89 of sleeve. The spring cage will thus mate with the sleeve from surface to surface. In this fashion, a broader contact area is created between the spring cage and the sleeve. The "pressure fit" and "broad contact area" created reduces the electrical resistance in the interface between the spring cage and sleeve.

A third purpose for this arcuate configuration is to structurally avoid the spring cage and sleeve collapsing or buckling after closing the dies 79 and 81 in FIG. 6*b*. This is the same principle as employed in an arcuate bridge, which is known to sustain substantial weight. To further avoid potential collapse, inwardly facing profiles 85 and 83 of compressing top die 79 and bottom die 81 (see again in FIG. 6*b*), respectively, define arcuate configurations which are according to the same dimensions as found in arcuate surfaces 87 and 89 of the sleeve in FIG. 6*c*. This additionally guarantees that the sleeve will not be over deflected or buckled. At same time, two inwardly and opposing protrusions 91 and 93 of mandrels 73 and 75, respectively in FIG. 6*b*, are actuated into an inside of arcuate portions 34' and 32'(without touching the contact beams at any point) of the spring cage 52. The protrusions 91 and 93 are also shown in arcuately flared configuration in FIG. 6*b*.

The arcuate distance 54 and 56 of the spring cage being slightly bigger than the arcuate distance 93 of mandrel 75, while the arcuate radius 54 and 56 of spring cage is again slightly smaller than the arcuate radius 93 of the mandrel 75. Thus, a small gap exists between the inner arcuate surfaces 54 and 56 of the spring cage and the arcuate surface 93 of mandrel 75. During crushing the sleeve, the small gaps allow the arcuate configurations provided by the surfaces 54 and 56 of the spring cage to be deflected and moved inward and the arcuate configuration 34' in FIG. 6*b*, or 54 and 56 in FIG. 12 of spring cage, will be compressed according to the arcuate shape of surfaces 87 and 89 of the sleeve. When the inner arcuate surfaces 54 and 56 of the spring cage finally meet the arcuate surface of the protrusion 93, the spring cage will be stopped from further deflecting or collapsing. After completing all above operations, the arcuate surfaces of the spring cage are deflected or squeezed by both crushing the sleeve and support from the arcuate protrusion 93 of mandrel 75 and thereby changed to different arcurate configurations. The squeezing of the spring cage guarantees imparting long term excellent mechanical and electrical performance in the interface created between the sleeve and spring cage.

Additional features of the sleeve also include cross wise extending and inwardly collapsed projections, see at 84 and 86 illustrated within opposite side faces 88 and 90, respectively, of the sleeve 58. The inward projections 84 and 86 are caused by applying a sufficient force to a substantially pointed and flat edged tool (not shown) and creating depressions (see at 92 and 94 in FIG. 7) within the faces 88 and 90 of the sleeve, the projections 84 and 86 in turn protecting the top and bottom beams 36' and 38', respectively, from being over-stressed or over-spread during insertion of the male blade or for other reasons. The gap 77 in FIG. 6*b* is understood to be big enough such that the spring cage can be freely passed between and within the projections 84 and 86 in FIG. 7.

Referring again to FIGS. 6 and 7, crimping locations 96 and 98 are indicated within the forward facing portion of the sleeve body 58 and proximate the open inserting end 82. The crimping locations receive a suitable pointed tool (not shown but understood to be such as a center punch). The tool is employed to provide additional (typically secondary) retaining force to the sub-assembly by "flaring out" portions of the sleeve material at the open inserting end 82 and thereby further limiting the forward movement of the cage 52 once it has been inserted and engaged within the sleeve 58. At least one lance 97 is also extruded near a back and bottom of the sleeve. The spring cage 52 will be stopped and fixed in place by the lance 97 during assembling. Both lance(s) 97 and crimping 96 and 98 trap the spring cage as supplemental retaining features. As previously explained, the primary force of retaining the spring cage inside the sleeve is established by the pressure fit created between the spring cage 52 and the sleeve 58.

Also illustrated is a pair of windows 100 and 102 (see FIGS. 6 and 8) defined within the sleeve (such as in its blank form 60) and so that, upon assembly to the configuration 58 of FIG. 6, the windows (illustrated in FIG. 6 as first window 100) are located along the corresponding side edges of the sleeve. The windows 100 and 102 provide a locking surface for a locking finger established inside the connector housing (not shown) and which is similar to any conventional connector housing design.

Also illustrated in the sleeve blank illustration of FIG. 8 and assembled illustration of FIG. 6 are a pair of gripping portions, see at 108 and 110, and which define a portion of the sleeve body connected to the main rectangular shaped portion by virtue of an interconnecting and electrically communicating web portion 111. The gripping portions 108 and 110 are crimped upon insertion of the exposed wire end of an associated cable (see again at 14 in FIG. 1) and in order that the sleeve electrically communicate the male terminal (see again at 12) with the cable 14. The gripping portions 108 and 110 are illustrated in substantially axially disposed fashion relative to the extending direction of the main body portion of the sleeve 58. However, it is also understood (with reference again to FIG. 1) that the terminal sleeve sub assembly 16 may include gripping portions which are bent or (in the instance of the embodiment of FIG. 3 as will be further described) otherwise formed in a perpendicularly (90°) angled fashion and so that it may be incorporated into the terminal socket housing assembly.

Figure 2:
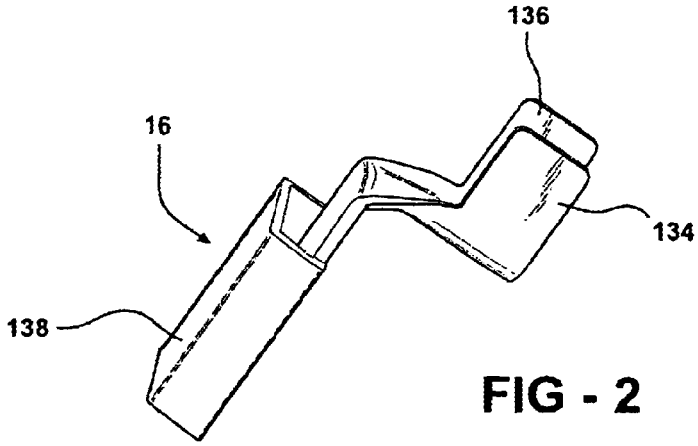
FIG. 2 is an isometric view of the bent 90° sleeve as illustrated in FIG. 1.

Referring again to FIGS. 1 and 2, as well as the substantially assembled connector illustration of FIG. 13 and the succeeding side cutaway of FIG. 14, the overall sealed socket assembly 10 is again shown according to the first preferred embodiment of the present invention. As previously described, the sleeve and encased spring cage (shown again at 52 in the cutaway of FIG. 14) forms a portion of a sealed and 90° angled assembly 10. It should also be noted that the connector housing assemblies provide additional sealing and insulating characteristics to the underlying terminal socket assembly, when employed in a given vehicular application, however the presence of any particular construction of housing assembly is not necessary according to the broadest dictates of the present invention, Referring again to FIG. 1 the overall housing/sealing assembly of the first embodiment is again shown and includes a female housing 112, typically constructed of a durable plasticized and insulating material and which includes a first portion 114, terminating in a first open end 116, and a second internally communicable portion 118, terminating in a second open end 120. The first 116 and second 120 open and inserting ends are established at a 90° angle relative to each other and the housing 112 defines an open interior for receiving an inserting end of the cable 14 through the first inserting end 116 and in a manner to be described.

Additional components of the terminal socket/housing assembly 10 include the provision of a flexible grommet 122 and grommet retainer 124. As best illustrated in the side cutaway of FIG. 14, the grommet 122 is inserted within the first open end 116 (see also FIG. 1) and, upon installation of the cable 14, the grommet retainer 124 (along with the grommet 122 including a centrally defined aperture such as evident at 123 for grommet 122 and at 125 for grommet retainer 124) is slid into engagement over the first open end 116.

Referring again to the side cutaway of FIG. 14, the male connector is again illustrated at 12 and includes a plasticized exterior combined with an interior extending and metal pin 142. Although not shown, the connector 10 forms part of a suitable wire harness assembly or other current conveying medium and, upon insertion of the pin through the aligning apertures 132 of the TPA 126 and 140 of the sleeve/spring cage subassembly 16, the pin 142 is inserted within the rectangularly formed and interiorly installed spring cage 52. Additional components include a substantially rectangular shaped and interiorly hollowed interface seal 144 which fits into a recessed location proximate the second open end 120 of the female housing 112 (see again FIG. 14). A likewise rectangular shaped seal retainer 146 includes an outwardly stepped and encircling lip portion and so that it fits over the open end 120 of the housing and is ultrasonically welded to the connector housing at the connector manufacturer.

A description of the manner in which the sealed socket assembly 10 is assembled will now be given and includes first inserting the interface seal 144 within the second open end 120 of the housing 112, and in its seating location illustrated in FIG. 14, at which point the window shaped seal retainer 146 is then affixed over the open housing end 120. A next step includes sliding the grommet retainer 124, and then the grommet 122, over an exposed wire end 148 of the cable 14 and advancing them a selected distance along an axial direction of the cable 14. The wire end 148 of the cable 14 is then inserted through the first open end 116 of the female housing 112, pushed through the communicating interior and across its 90° bend, and extended up to several inches beyond the second exposed end 120 of the housing 112. At that point, the gripping portions 134 and 136 of the sleeve/spring cage subassembly 16 are crimped about the exposed wire end 148 of the cable 14 and that cable and its crimped sleeve/spring cage subassembly are then withdrawn to its final position, as shown in cutaway view FIG. 14, in which the exposed wire end 148 is in electrical communication with the gripping portions 134 and 136. Additional installation step includes insertion of the terminal position assurance (TPA) 126 into the second open end 120 of the female housing 112.

Referring again to FIG. 1 and to FIG. 14, the sleeve/spring cage subassembly 16 is mated or jacketed within an interiorly open end of a terminal position assurance (TPA) element 126. In FIG. 1, the TPA 126 is likewise constructed of a durable and plasticized material and includes an enlarged upper portion 128, reduced size lower portion 130, and an interiorly open passageway leading to a bottom accessible aperture 132. Defined within the upper portion 128 is an inwardly configured slot 132, communicable with a top surface 133 of the TPA 126, and which in turn seats the 90° angled configuration of the extending gripping/crimping tabs (see at 134 and 136) associated with the sleeve/spring cage subassembly 16 and upon insertion of the rectangular configured portion, see at 138, with an open bottom 140 of the sleeve subassembly 16 being insertably engaged within the TPA 126 and communicable with its bottom aperture 126. Upon inserting the TPA 16 into the connector housing and jacketing over the sleeve/spring cage subassembly, two locking tabs 133' extending from locations along the upper enlarged portion 128 of the TPA are engaged with locking features (it understandably similar to any conventional locking features) located inside the connector housing (not shown) and fixed at a non-movable position. Because so, the sleeve/spring cage subassembly is secured and assured at a desired position shown in FIG. 14. Final assembly includes the grommet 122 and grommet retainer 124 being slid along the cable and into engagement over the first open end 116 of the housing, as shown in FIG. 14.

Referring finally to FIGS. 3 and 5, an electric terminal socket assembly 150 is illustrated according to a further preferred embodiment of the present invention. The construction of the socket assembly 150 largely replicates that illustrated at 10 in the corresponding views of FIGS. 1 and 13, with the exception of some alternate configurations, which will now be explained. Specifically, the subassembly including the sleeve and interiorly held spring cage is referenced at 152 and differs from that identified at 16 in the first embodiment in that the sleeve component provides a more flattened, streamlined and formed (as opposed to bent) configuration. As with the first disclosed embodiment, the rectangular shaped spring cage, such as again is illustrated at 52 in FIGS. 10–12, is also shown inserted into the open end 154 of the sleeve subassembly 152.

The main and rectangular shaped body portion of the sleeve subassembly 152 may, in certain applications, be constructed as one piece. Alternatively, and as discussed previously, it is also contemplated that alternating keyed portions 156 and 158 may be formed on opposing and interlocking edge locations of the sleeve corresponding with the location of the inserted spring cage and may be compress fitted in the fashion previously described in order to frictionally secure the spring cage 52 in interiorly held and electrically communicable fashion. Gripping portions 160 and 162 extend from an end 164 of the sleeve subassembly and, as disclosed in the previous embodiment, are crimped to the extending wire end 148 of the cable 14 during the socket assembly process.

Referring again to FIGS. 3 and 5, additional components of the assembly 150 according to the second embodiment include a female housing 166, typically again constructed of a durable plasticized and insulating material and which includes a first portion 168, terminating in a first open end 170, and a second internally communicable portion 172, terminating in a second open end 174. The first 170 and second 174 open and inserting ends are established at a 90° angle relative to each other and the housing 166 again defines an open interior for receiving an inserting end of the cable 14 through the first inserting end 170 in the manner described.

Additional components of the terminal socket/housing assembly 150 according to the second variant include the provision of a flexible grommet 176 and grommet retainer 178. As best illustrated in the side cutaway of FIG. 14, the grommet 176 is inserted within the first open end 170 and, upon installation of the cable 14, the grommet retainer 178 (along with the grommet 176 again including a centrally defined aperture) is slid into engagement over the first open end 170.

The sleeve/spring cage sub-assembly 152 is then inserted within an interiorly open end of a terminal position assurance (TPA) element shown at 180, the TPA 180 again being constructed of a durable and plasticized material, or suitable insulating material, and including an enlarged upper portion 182, reduced size lower portion 184, and an interiorly open passageway leading to a bottom accessible aperture 186. The upper portion 182 of the TPA is configured, as illustrated by multiple surfaces 188, and in order to seat the 90° angled configuration of the extending gripping/crimping tabs (see at 160 and 162) associated with the sleeve/spring cage subassembly 152 and upon insertion of the rectangularly configured portion of the sub-assembly 152 within the TPA 180 and communicable with its bottom aperture 186. Also illustrated are locking tabs 185 (one of which is evident in FIG. 3) on opposite sides of the multiple surface configuration 188 of the TPA upper portion 182 and which function as the tabs 133' previously identified in the embodiment of FIG. 1.

The male connector is again illustrated at 12 and, as described with reference to the first embodiment in FIG. 14, includes a plasticized exterior combined with an interior extending and metal blade 142. Upon insertion of the pin through the aligning apertures 186 of the TPA 180 and 154 of the sleeve/spring cage subassembly 152, the connector pin is inserted within the rectangularly formed and interiorly installed spring cage 52, just as in the first preferred variant. Additional components again include a substantially rectangular shaped and interiorly hollowed interface seal 190 which fits into a recessed location proximate the second open end 174 of the female housing 166. A likewise rectangular shaped seal retainer 192, again including an outwardly stepped and encircling lip portion, fits over the second open end 174 of the housing to seal the socket assembly 150, from the male connector after both the male and female connectors are mated. The steps for constructing the connector assembly 150 are otherwise the same as previously disclosed for the assembly 10, such that a repetitive description is not necessary.

A method for assembling a terminal socket assembly for interconnecting input sources of a vehicle, such as again the cable 14 and male connector 12, extending from the electrically powered vehicular components is also disclosed, in combination with the afore-described assembly, and includes the steps of providing at least one spring cage blank with first and second extending edges and a plurality of spaced apart and angled, curved, and torsioned or twisted beams extending between the extending edges, and the step of forming the spring cage blank into the substantially "rectangular" shaped configuration and in which the angled beams are shaped in a combined inwardly deflected and torsioned fashion. Additional steps include providing the substantially rectangular shaped and interiorly hollowed sleeve, insertably assembling the formed spring cage into an open end of the sleeve, compressingly actuating the sleeve in biasing and pressured fashion and with a broad contact area established between the sleeve and spring cage and about the periphery of the spring cage, and biasingly engaging the male pin within the assembled spring cage and sleeve so that the sleeve grips an extending end of a second cable at a further location, such as through crimping of associated gripping tabs, to electrically communicate the male blade 142 with the cable 14.

The present invention therefore discloses an improved terminal socket assembly having reduced number of component, minimized joints through electrical power path from the male blade through cable at sleeve end which, therefore, increased effective contact area through the electrical power path compared to prior art type pin or blade terminals. The forming process in progression die is used for making cage into the desired rectangular shape. All assembly processes, blanking and forming sleeves are built into the same progression die and the use of progression die carriers in an automation process provides greater economies of scale in manufacture of the socket assemblies.

The socket assembly is also constructed of a simplified two-piece component arrangement and has been found to require less material and forming operations than other conventional assemblies, as well as offering high and reliable performance. Finally, the terminal socket assembly has been found to be cost effective for in particular high current applications and can be used to replace existing nut and bolt power connection systems, thus eliminating torque or cross threading problems. The male blade (see again at 12 and at 142 in FIG. 14) is stamped as part of copper sheet which simplifies the stamping process compared to stamping a round hollow pin or saving a component for the solid pin. The power blade terminal also provides a good solution for space limitation in a given direction and in some applications. Further, the sealed 90° female connection is feasibly employed within this invention by following the specific connector assembly process and taking into account the certain 90° configurations of the sleeve.

Having described the presently preferred embodiments, it is to be hat the invention may be otherwise embodied within the scope of the aims.

What is claimed is:

1. A terminal socket assembly for interconnecting electrically powered vehicular components with a male input blade and an output cable, said socket assembly comprising:

a generally rectangular spring cage blank having extending side and end border edges and at least one individual plurality of spaced apart beams arranged between said border edges;

said spring cage blank being shaped into a substantially three dimensional and rectangular configuration and in which said beams are arranged in a substantially angled pattern and such that each of said beams is angled in a first axially extending direction, torsioned in a second perpendicular extending direction, and curved inwardly in a third vertical direction; and a sleeve including a substantially rectangular shaped portion for receiving said spring cage in axially inserting and fixedly retaining fashion, the male input blade being biasingly mated with said interiorly hollowed sleeve and assembled spring cage to thereby create decreased inserting forces and increased normal directed holding forces between said input blade and said sleeve and cage, said sleeve further comprising gripping portions for fixedly engaging an extending end of the cable.

2. The assembly as described in claim 1, said spring cage blank being constructed of a high tensile copper, said beams further comprising, in front and side profiles, a combined three dimensional and arcuate shape.

3. The assembly as described in claim 2, further comprising first and second individual pluralities of beams associated with first and second spaced apart faces of said configured spring cage, each of said individual plurality of beams extending in a predetermined spaced and opposing direction relative to each other.

4. The assembly as described in claim 1, further comprising first and second carrier strips securing, in spaced apart and parallel extending fashion, to said first and second extending edges of said spring cage blank.

5. The assembly as described in claim 1, further comprising said sleeve exhibiting opposing edges defined by a plurality of meshing keyed portions.

6. The assembly as described in claim 5, said sleeve further comprising top and bottom profiles, and a combined three dimensional and arcuate shape, further comprising a predetermined spacing existing within said meshing keyed portions, an applied compressing force with said keyed portions of said sleeve creating an interference fit with said axially inserted spring cage.

7. The assembly as described in claim 1, further comprising at least one crimping location along a front inserting face of said sleeve, said location being engaged by a tool, subsequent to insertion of said cage into said sleeve, and in order to create additional retaining force of said inserted spring cage.

8. The assembly as described in claim 1, said sleeve further comprising, at a back bottom of said rectangular sleeve, at least one lance extrusion functioning as a forward stop, upon inserting said spring cage, and acting as a supplemental retaining feature to said spring cage.

9. The invention as described in claim 1, said sleeve being originally provided as a blank constructed of a high tensile copper, a pair of first and second carrier strips securing, at individual and spaced apart locations, to said sleeve blank.

10. The assembly as described in claim 1, said sleeve having at least one open and inserting end, said gripping portions extending in substantially 90 degree fashion from said inserting end of said sleeve.

11. The assembly as described in claim 1, further comprising said beams being over-stress protected, said sleeve further comprising a pair of inwardly collapsed projections which are pre-calculated such that selected beams contact said projections after insertion of the male input blade and in order to create additional current flow paths.

12. A method for assembling a terminal socket assembly for interconnecting electrically powered vehicular components with associated input male blade and output cable, said method comprising the steps of:

providing at least one spring cage blank with extending side and end border edges and at least one individual plurality of spaced apart beams arranged between said border edges;

forming said border edges each into an arcuate configuration;

forming said spring cage blank into a substantially three dimensional and rectangular configuration and in which said beams are arranged in a substantially angled pattern, both end portions of said spring cage establishing an outwardly flared arcuate configuration;

providing a substantially rectangular shaped and interiorly hollowed sleeve, exhibiting slightly arcuate configuration in a top and bottom thereof;

insertably assembling said formed spring cage into an open end of said sleeve;

compressingly actuating said sleeve in biasing fashion about said spring cage, so that said sleeve and spring cage withstand substantially inward compressing forces and without collapsing due to said arcuate configurations of said spring cage and sleeve;

biasingly engaging a male blade with said assembled spring cage and sleeve; and gripping means associated with an end of said sleeve, opposite said spring cage inserting end, and for engaging an extending end of the cable at a further location to electrically communicate the male blade with the cable.

13. The method as described in claim 12, further comprising the step of at least one lance extrusion at a bottom end location of said sleeve in order to restrain forward movement of said inserted spring cage.

14. The method as described in claim 12, further comprising the step of said spring cage being retained by a supplemental holding force provided by at least one flared portion established at a front face of said sleeve.

15. The method as described in claim 12, further comprising the step of compressively actuating an outer surface of said sleeve between a pair of mandrels, thereby forcing an arcuate configuration of said spring cage to follow an associated arcuate configuration of said sleeve, resulting further in a broadened contact area established between said mating spring cage and sleeve.

16. The method as described in claim 12, further comprising the step of angling each of said each of said beams of said spring cage blank in a first axially extending direction, curving each of said beams in a second direction, and torsioning each of said beams in a third direction.

17. The method as described in claim 16, further comprising the step of arraying first and second individual pluralities of beams along first and second faces of said three dimensionally formed spring cage assembly, each of said first and second pluralities of beams extending in a predetermined spaced and opposing direction relative to each another.

18. The method as described in claim 12, further comprising the step of encasing said terminal socket assembly and associated male blade and cable within an angled and sealed connector housing.

19. The method as described in claim 18, further comprising the step of angling gripping portions of said sleeve relative to a direction of said insertably assembled spring cage.

20. The method as described in claim 19, said step of encasing further comprising a grommet and grommet retainer engageable with a first inserting end of said housing and contacting said cable.

21. The method as described in claim 19, said step of encasing further comprising a terminal position assurance element seating said sleeve and spring cage, said position assurance element and in turn engaging within a second inserting end of said housing in communication with said gripping portions.

22. The method as described in claim 12, further comprising the step of encasing comprising said cable being pushed through said connector housing and passing a 90° corner of said connector housing.

23. The method as described in claim 12, further comprising the step of said cable being crimped to associated grip portion of a terminal subassembly.

24. The method as described in claim 23, further comprising the step of said cable-terminal subassembly being withdrawn to a final position within said housing.

25. A terminal socket assembly for interconnecting electrically powered vehicular components with a male input blade and an output cable, said socket assembly comprising:

a generally rectangular spring cage blank having extending side and end border edges and at least one individual plurality of spaced apart beams arranged between said border edges;

said spring cage blank being shaped into a substantially three dimensional and rectangular configuration and in which said beams are arranged in a substantially angled pattern;

a sleeve including a substantially rectangular shaped portion for receiving said configured spring cage in axially inserting and fixedly retaining fashion, the male input blade being biasingly mated with said interiorly hollowed sleeve and assembled spring cage, said sleeve further comprising gripping portions for fixedly engaging an extending end of the cable;

further comprising an inserting end of said rectangular shaped portion of said sleeve establishing an arcuate profile and being dimensioned to be slightly smaller in a first direction and slightly bigger in a second direction, respectively, to a corresponding outer configuration of said inserted cage and in order to pressure retain said cage inside said rectangular sleeve after actuation of an inwardly compressing force.

26. The assembly as described in claim 25, further comprising a broad contact area being established between said sleeve and spring cage and due to said beams of said spring cage following an arcuate shape of said sleeve after actuation of said inwardly compressing force.

27. The assembly as described in claim 25, further comprising an arcuate configuration of said spring cage and an arcuate configuration of said sleeve capable of withstanding a substantial exterior and inwardly directed compression force without collapsing.

28. The assembly as described in claim 25, further comprising first and second opposing mandrels employed for configuring said spring cage, an inserting end of each mandrel exhibiting an inserting end with an arcuate distance and arcuate radius dimensioned to be slightly smaller in a first direction and slightly bigger in a second direction, respectively, than a corresponding inner configuration of said inserted spring cage formed by said mandrel and in order to further assist in maintaining an arcuate shape of said spring cage after actuation of said inwardly compressing force and to assist in avoiding collapsing of said sleeve and spring cage during assembling.

29. The assembly as described in claim 25, said sleeve further comprising at least one window defined within said rectangular shaped portion, said window receiving a locking finger which is associated with said connector housing.

30. The assembly as described in claim 25, said sleeve further comprising at least one flared portion defined at a front face of said sleeve and acting as a supplemental retaining spring cage after inserting said spring cage into said sleeve.

31. A terminal socket assembly for interconnecting electrically powered vehicular components with a male input blade and an output cable, said socket assembly comprising:

a generally rectangular spring cage blank having extending side and end border edges and at least one individual plurality of spaced apart beams arranged between said border edges;

said spring cage blank being shaped into a substantially three dimensional and rectangular configuration and in which said beams are arranged in a substantially angled pattern;

a sleeve including a substantially rectangular shaped portion for receiving said configured spring cage in axially inserting and fixedly retaining fashion, the male input blade being biasingly mated with said interiorly hollowed sleeve and assembled spring cage, said sleeve further comprising gripping portions for fixedly engaging an extending end of the cable;

an angled and sealed connector housing for encasing said terminal socket assembly and associated male input blade and output cable, said connector housing further comprising:

a housing having an open interior communicable with first and second open and inserting ends which are established at an angle relative to one another, said housing encasing said assembled sleeve and interiorly installed spring cage; and said gripping portions extending at an angle relative to said sleeve, in proximity to a selected inserting end of the female housing, and for engaging an exposed wire end of the cable, the male blade being engageable with said spring cage/assembled sleeve contained within said housing.

32. The assembly as described in claim 31, further comprising a grommet inserted within said first open and inserting end of said housing, a grommet retainer engageable over said first end, each of said grommet and retainer including a central aperture for permitting passage of the cable therethrough.

33. The assembly as described in claim 31, further comprising a terminal position assurance member having a body and an interiorly communicating passageway, said sleeve seating within an upper open end of said terminal position assurance, said assurance in turn inserting into said second open end of said housing, an open bottom of said position assurance communicating the male blade with said sleeve and interiorly held spring cage.

34. The assembly as described in claim 31, further comprising an interfacial seal and seal retainer engageable over said second inserting end of said housing.

35. The assembly as described in claim 34, said assembled connector housing have a specified shape and configuration and further comprising ultrasonic welding said seal retainer to said second inserting end of said connector housing.

36. The assembly as described in claim 31, said assembled connector housing having a substantially 90 degree shaped configuration.

37. The assembly as described in claim 36, further comprising the cable being pushed through an interior of said 90 degree angled housing, an end of the cable being crimped to said gripping portions of said terminal sleeve, the cable subsequently being withdrawn to draw said sleeve assembly such said gripping portions pass through a corner of said 90 degree path inside said female housing.

38. The assembly as described in claim 37, said gripping portions of terminal sleeve being arranged substantially proximate to said sleeve body such that said gripping portions may easily passes through said corner of 90 degree path inside said female housing.

* * * * *